US005377640A

United States Patent [19]

Kobayashi

[11] Patent Number: 5,377,640

[45] Date of Patent: Jan. 3, 1995

[54] PLUG CAP DEVICE

[75] Inventor: Yoshinao Kobayashi, Mie, Japan

[73] Assignee: Sumitomo Wiring Systems, Ltd., Yokkaichi, Japan

[21] Appl. No.: 78,645

[22] Filed: Jun. 21, 1993

[30] Foreign Application Priority Data

Jul. 23, 1992 [JP] Japan ..... 4-057849[U]
Aug. 19, 1992 [JP] Japan ..... 4-063974[U]

[51] Int. Cl.[6] ..... F02P 23/00
[52] U.S. Cl. ..... 123/143 C
[58] Field of Search ..... 123/143 C, 195 C, 198 E, 123/169 PA, 169 PH; 439/130, 127, 125, 686, 620; 200/19

[56] References Cited

U.S. PATENT DOCUMENTS 1,748,650 2/1930 Hollenbeck ..... 200/19
2,835,724 5/1958 Colbert ..... 123/143 C
2,904,769 9/1959 Sampson et al. ..... 123/143 C
3,545,250 2/1972 Estes ..... 123/143 C
4,205,642 6/1980 Nishimura et al. ..... 123/143 C
4,723,211 5/1988 Hirata et al. ..... 439/686
4,790,767 12/1988 Sturdevan et al. ..... 439/125
5,154,624 10/1992 Lemajeur et al. ..... 439/130
5,302,131 4/1994 Hertitier-Best ..... 439/127

FOREIGN PATENT DOCUMENTS 0488216 6/1992 European Pat. Off. .
2596589 10/1987 France .
2165000 4/1986 United Kingdom .

*Primary Examiner*—Raymond A. Nelli
*Attorney, Agent, or Firm*—Sughrue, Mion, Zinn, Macpeak & Seas

[57] ABSTRACT

A plug cap device has a plug cap body 110 provided with a groove 140 on the outer periphery. The groove 140 constitutes an air flow passage 150. The plug cap body 110 is provided with a recess in an intermediate portion of the air flow passage 150 on the outer periphery thereof so that the recess constitutes a water reservoir 260. High pressure air in a plug bore 102 is discharged through the air flow passage 150 from a vent hole 123 to an external area, thereby improving to vent the air. Water which enters the air flow passage 150 from the vent hole 123 is trapped in the water reservoir 260 so that the water is prevented from entering the plug bore 102.

9 Claims, 14 Drawing Sheets

PLUG CAP DEVICE

BACKGROUND OF THE INVENTION

1. Field of the Invention

This invention relates to a plug cap device to be applied to a DOHC (double overhead cam shaft) type gasoline engine or the like.

2. Statement of the Prior Art

For convenience of explanation, a prior plug cap device will be explained below. FIG. 27 is a side view of a prior plug cap device, in which a main part of the device is shown in a cross sectional view. As shown in FIG. 27, the prior plug cap device comprises an elongate cylindrical plug cap body 10 made of a synthetic resin and a rain cover 20 which constitutes a water-proof cover. The plug cap body 10 is provided with a rib 11 on the outer periphery of an upper end. A cylindrical rubber cap 12 is mounted on a lower end of the body 10.

The rain cover 20 made of an elastic material is fitted on the upper end of the plug cap body 10 with the rib 11 on the body 10 being mated with an annular recess 22 formed on the inner periphery of an aperture 21 in the cover 20. A vent hole 23 is formed in an upper portion of a wall defining the aperture 21 in the cover 20. A groove 25 is formed ill the inner periphery of the aperture 21 at positions from the vent hole 23 to the lower end of the rain cover 20. An air flow passage 24 is defined between the inner periphery of the groove 25 and the outer periphery of the plug cap body 10.

An ignition cable 30 is inserted from the upper end of the rain cover 20 through a body of the cover 20 into the plug cap body 10. A discharge tube unit and a connecting terminal (not shown) connected to an end of the ignition cable 30 is received in a lower half portion of the plug cap body 10.

The plug cap body 10 is inserted into a plug bore 2 in an engine body 1 and the connecting terminal received in the lower end of the plug cap body 10 is coupled together with a rubber cap 12 to a plug secured to an attaching portion 3 on the bottom of the plug bore 2. Further, a lower portion 20*a* of the rain cover 20 is airtightly engaged with an upper end of the plug bore 2, so that the rain cover 20 seals the plug bore 2 from an external area except the vent hole.

In the plug cap device, when an inner pressure rises due to a rise in temperature, air trapped in the plug bore 2 is discharged through the air flow passage 24 from the vent hole 23 into tile external area, thereby avoiding a rise of an inner pressure In the plug bore 2 and avoiding of floating the rain cover 20 due to the rise of the inner pressure in the bore 2.

In the plug cap device described above, since some elements such as the discharge tube unit and the like are received in the plug cap body 10, an outer diameter of the body 10 becomes large and thus an inner diameter of the aperture 21 in the rain cover 20 becomes large. On the contrary, since a diameter of the plug bore 2 is maintained to be constant, a thickness of the rain cover 20 must be thin. If the groove 25 for the air flow passage is formed in the rain cover 20, the thickness of the cover 20 at the groove 25 becomes thinner and this causes a deterioration in rigidity of the rain cover 20.

When an engine or a body in a motor car is washed, water enters from the vent hole 23 through the air flow passage 24 into the plug bore 2 in the prior plug cap device. The water in the plug bore 2 causes a deterioration in electrical insulation of the plug cap body 10 and thus causes an ignition voltage at the ignition plug to be lowered and the ignition plug to be fired.

SUMMARY OF THE INVENTION

An object to the present invention is to provide a plug cap device having a rain cover with improved rigidity.

Another object of the present invention is to provide a plug cap device which can prevent water from entering into a plug bore.

In order to achieve the above objects, a plug cap device of the present invention comprises:

- a cylindrical plug cap body adapted to be detachably inserted into a plug bore extending vertically in an engine body;
- a water-proof elastic cover adapted to be detachably and sealingly fitted in an upper end of said plug bore at a lower end thereof, said cover having an aperture for receiving an upper portion of said plug cap body and a vent hole in a wall defining said aperture;
- an air flow passage being formed between said plug cap body and said water-proof elastic cover so that air in said plug bore is discharged through said vent hole to an external area; and
- a groove being formed on the outer periphery of said plug cap body so that said groove constitutes at least a part of said air flow passage.

According to the plug cap device of the present invention, since at least a part of the air flow passage is constructed by the groove formed in the plug cap body, it is not necessary to form a groove for an air flow passage in the water-proof cover at the area of the groove formed in the plug cap body. Accordingly, it is possible to make the water-proof cover relatively thick which enhances the rigidity of the water-proof cover.

Further, in the plug cap device of the present invention, a groove may be formed in the outer periphery of said plug cap body so that said groove constitutes at least a part of said air flow passage, and a recess may be formed on the outer periphery of said plug cap body so that said recess defines a water reservoir in an intermediate portion of said air flow passage.

According to the plug cap device of the present invention, since at least a part of the air flow passage is formed from the groove formed in the plug cap body, it is not necessary to form a groove for an air flow passage in the water-proof cover at the area of the groove formed in the plug cap body. Accordingly, it is possible to make the water-proof cover relatively thick which enhances its rigidity. Also, since the water reservoir is formed from the recess formed in the outer periphery of the plug cap body at the intermediate portion of the air flow passage, high pressure air trapped in the plug bore is discharged through the air flow passage from the vent hole into an external area. On the other hand, water which enters from the vent hole into the passage is received in the water reservoir and is prevented from entering the plug bore.

DETAILED DESCRIPTION OF THE PREFERRED EMBODIMENTS

Figure 1:
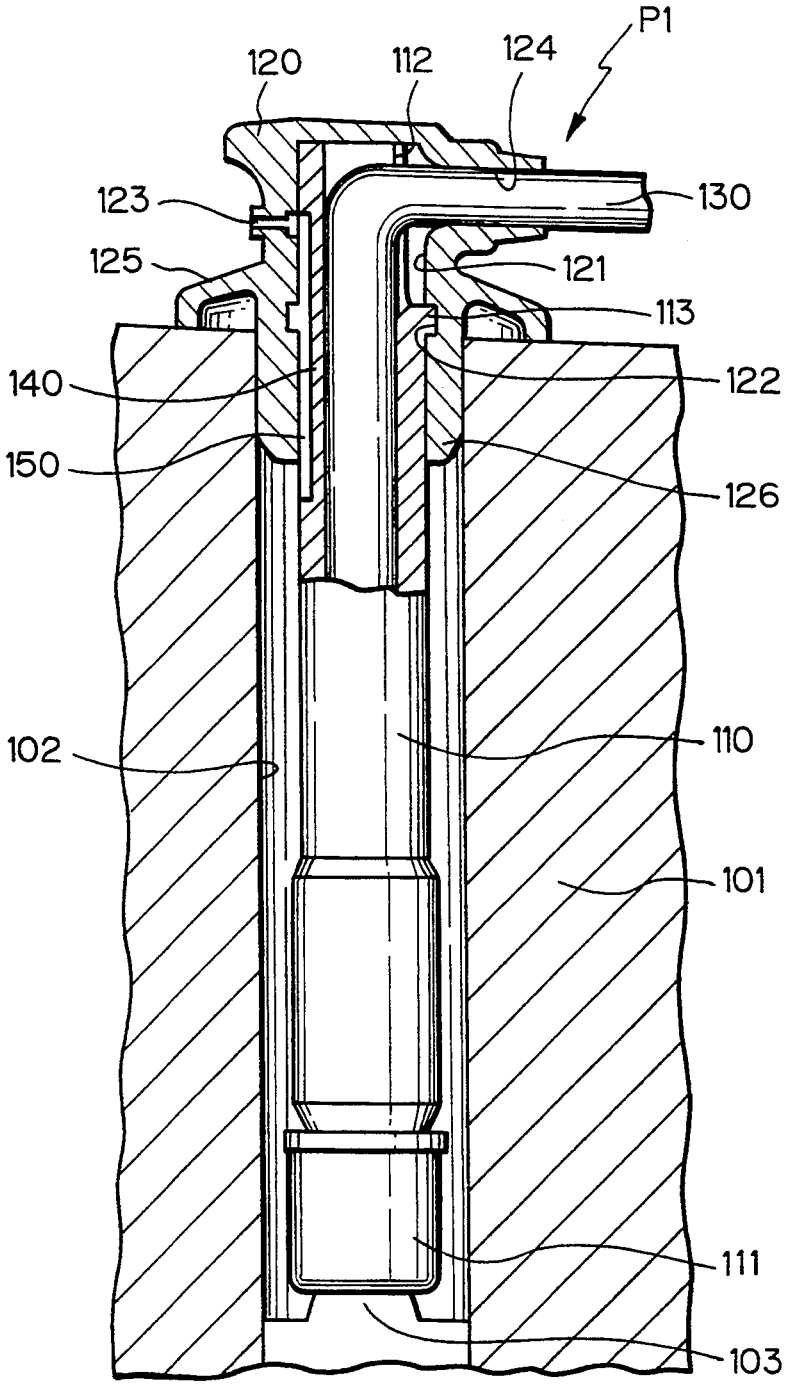
FIG. 1 is a side view of a first embodiment of a plug cap device of the present invention, in which a main part of the device Is shown in a cross sectional view.
Figure 2:
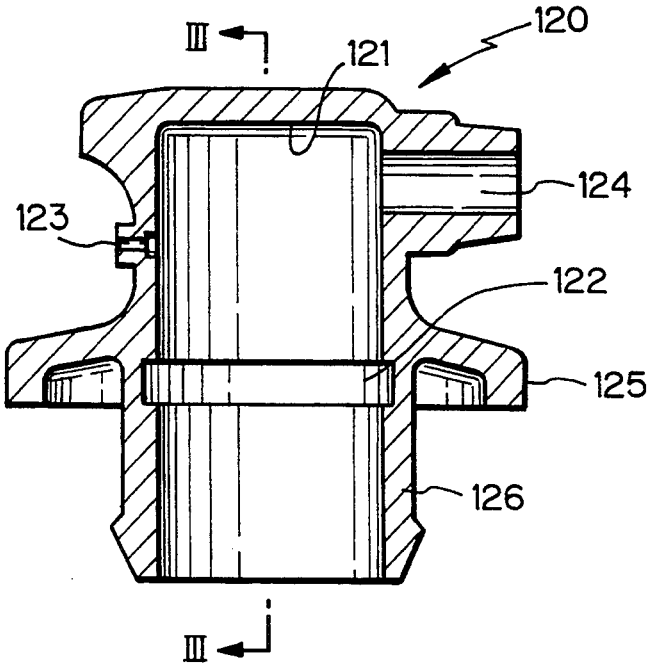
FIG. 2 is a cross sectional view of a rain cover to be applied to the first embodiment of the plug cap device.
Figure 3:
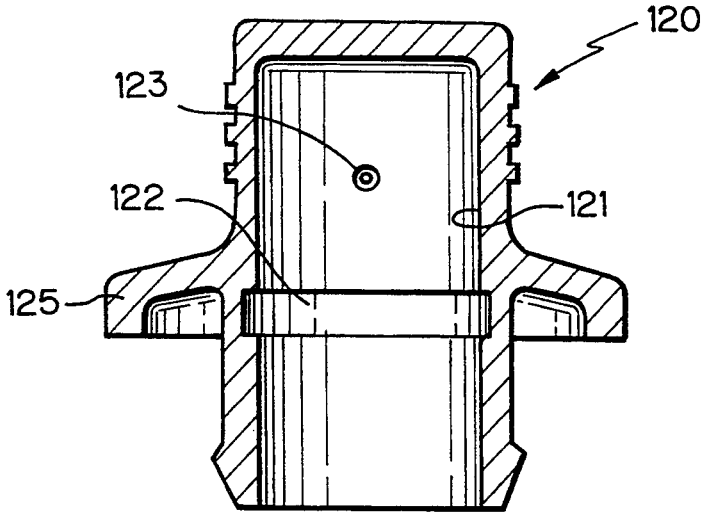
FIG. 3 is a cross sectional view taken along lines III—III in FIG. 2.
Figure 4:
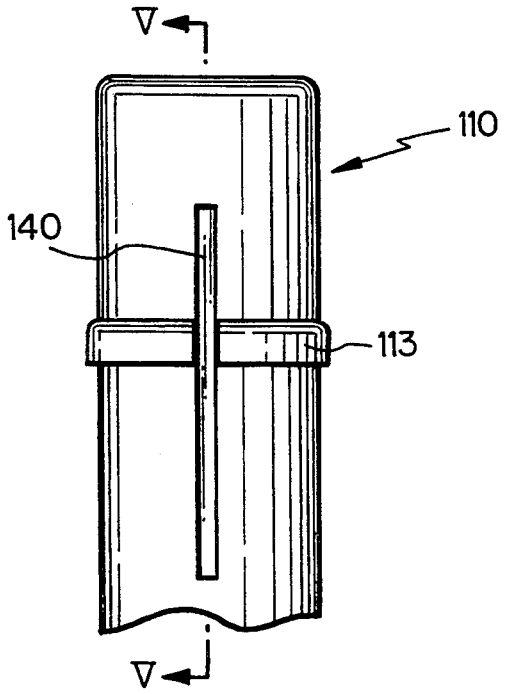
FIG. 4 is a side view of a plug cap body to be applied to the first embodiment of the plug cap device.
Figure 5:
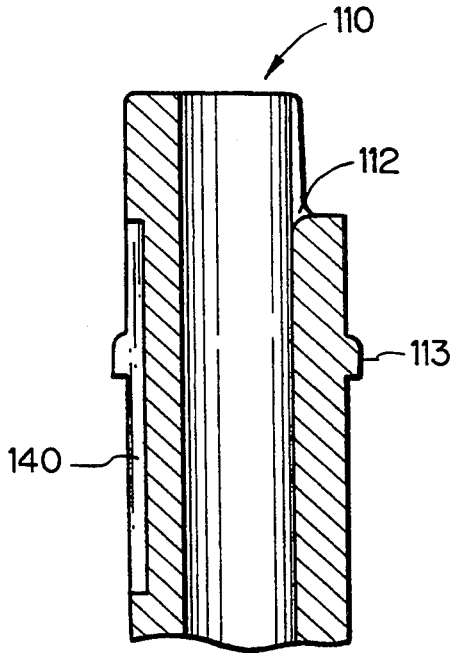
FIG. 5 is a cross sectional view taken along lines V—V in FIG. 4.
Figure 6:
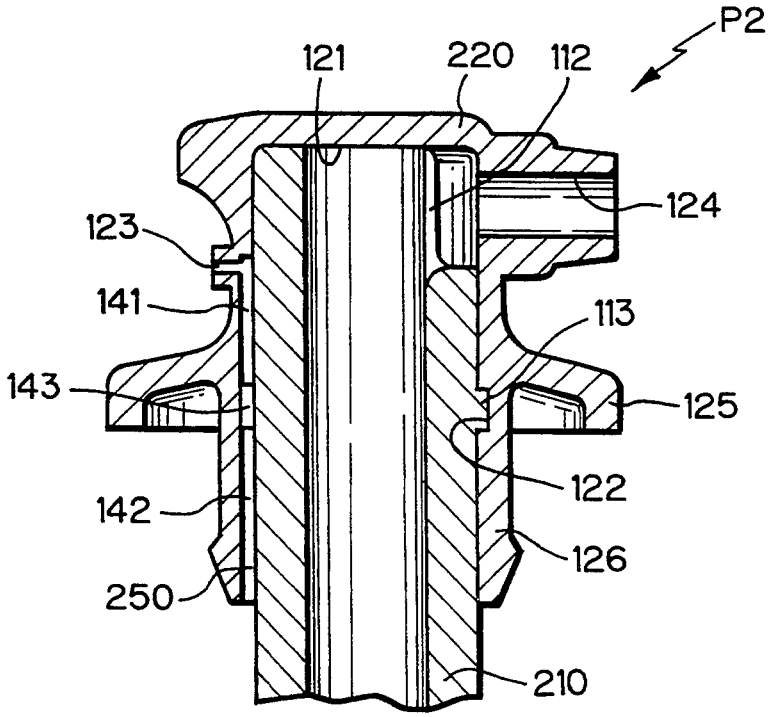
FIG. 6 is a cross sectional view of a part of a second embodiment of a plug cap device of the present invention.
Figure 7:
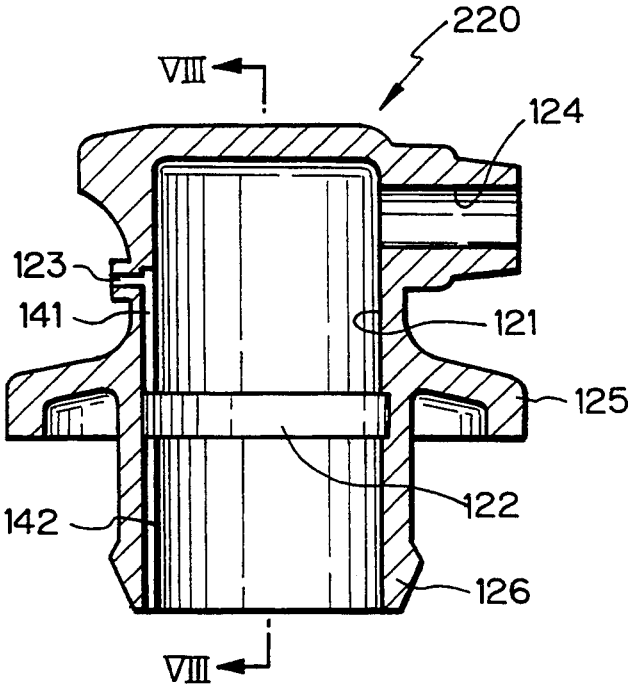
FIG. 7 is a cross sectional view of a rain cover to be applied to the second embodiment of the plug cap device.
Figure 8:
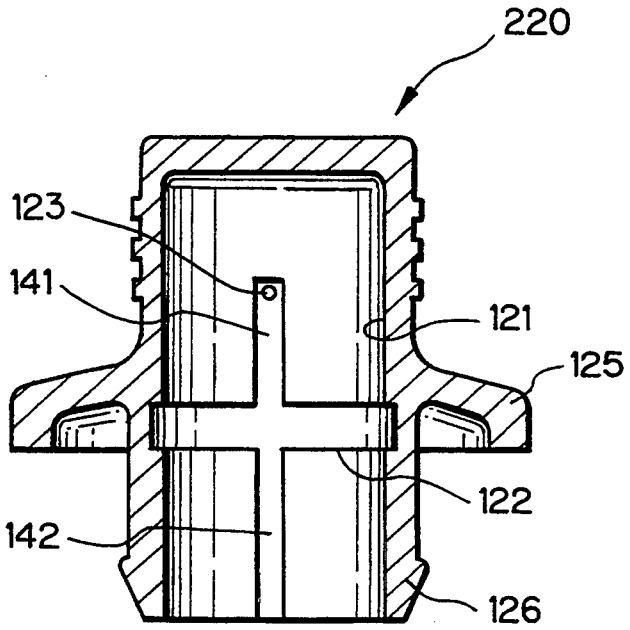
FIG. 8 is a cross sectional view taken along lines VIII—VIII in FIG. 7.
Figure 9:
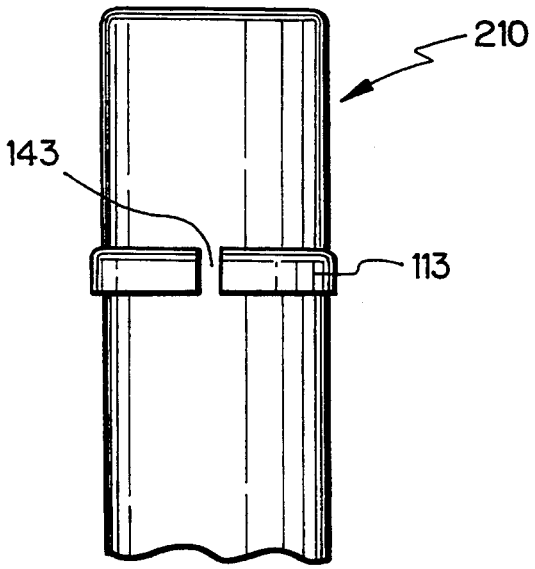
FIG. 9 is a side view of a plug cap body to be applied to the second embodiment.
Figure 10:
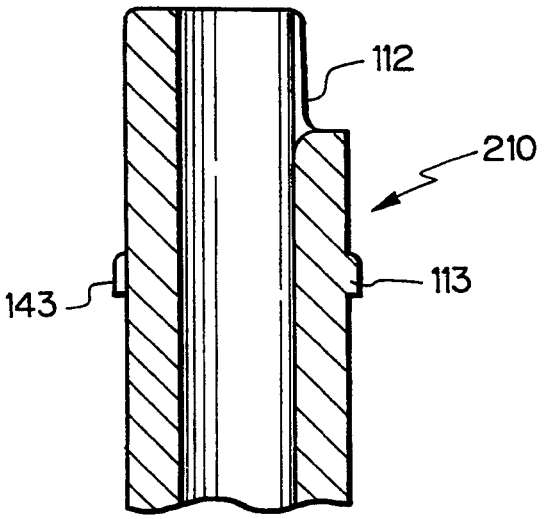
FIG. 10 is a cross sectional view of the plug cap body to be applied to the second embodiment.

Referring now to the drawings, embodiments of a plug cap device of the present invention will be explained below.

FIGS. 1 through 5 show a first embodiment P1 of the plug cap device of the present invention. As shown in the drawings, the plug cap device P1 comprises an elongate cylindrical plug cap body 110 made of a synthetic resin material and a rain cover 120 which constitutes a water-proof cover.

The rain cover 120 is made of an elastic material. The rain cover 120 is provided with an aperture 121 which receives an upper end of the plug cap body 110. An annular recess 122 is formed on the inner periphery of the aperture 121. The rain cover 120 is provided with a vent hole 123 in a peripheral wall and with an umbrella-like grommet 125 on the outer periphery of the peripheral wall. The rain cover 120 is provided with an opening 124 through which an ignition cable 130 passes into the plug cap body 110.

The plug cap body 110 is provided in an upper end with an opening 112 through which the ignition cable 130 is inserted and on the outer periphery of the upper end with an annular rib 113, a part of which is slotted to constitute a part of a groove 140 to be described hereinafter. The upper end of the plug cap body 110 is inserted into the aperture 121 of the rain cover 120 so that the rib 113 engages with the annular recess 122 in the rain cover 120.

The groove 140 which constitutes an air flow passage is formed longitudinally on the outer periphery of the upper end of the plug cap body 110. The groove 140 extends from a position communicating with the vent hole 123 in the rain cover 120 to a position being below an lower end of the rain cover 120 and communicating with a plug bore 102 to be described hereinafter. An air flow passage 150 is defined between the inner surface of the groove 140 and the inner periphery of the aperture 121 in the rain cover 120.

An end of the ignition cable 130 is inserted from the opening 124 in the rain cover 120 through the opening 112 in the plug cap body 110 into an upper half portion of the body 110. A discharge tube unit, a connecting terminal, and the like (not shown) connected to the end of the ignition cable 130 are received in a lower half portion of the plug cap body 3.10. In addition, a cylindrical rubber cap 111 is attached on a lower end of the plug cap body 110.

When the plug cap device P1 with the ignition cable 130 is assembled on an engine, as shown in FIG. 1, the plug cap body 110 is inserted into the plug bore 102 in an engine body 101 and the connecting terminal mounted on the lower end of the plug cap body 110 is coupled to a plug attached on a plug-mounting portion 103 on the bottom in the plug bore 102. Further, a lower portion 126 of the rain cover 120 is airtightly mated in an upper end of the plug bore 102 so that the grommet 125 of the rain cover 120 covers a peripheral area around the opening of the plug bore 102.

In the plug cap device P1, when an inner pressure in the plug bore 102 is raised upon a rise in temperature in the bore, air trapped in the plug bore 102 is discharged through the air flow passage 150 from the vent hole 123 into an external area, thereby avoiding a rise in the inner pressure in the plug bore 102 and avoiding of floating the rain cover 120 due to the rise of the inner pressure in the bore 102.

In the plug cap device P1, since the groove 140 is formed on the outer periphery of the plug cap body 110 and the groove 140 constitutes the air flow passage 150, it is not necessary to form the groove for the air flow passage in the rain cover 120 and it is possible to make the rain cover 120 relatively thick which enhances its rigidity.

Even if a width of the groove 140 becomes large, the thickness of the rain cover 120 does not become large and thus it is possible to form the air flow passage 150 with a size suitable for venting air.

FIGS. 6 through 11 show a second embodiment P2 of the plug cap device of the present invention. As shown in the drawings, a rain cover 220 is provided on the inner periphery of the aperture 121 with a first groove 141 extending from the vent hole 123 to the annular recess 122 and with a second groove 142 extending from the annular recess 122 to the lower end of the rain cover 220. The annular rib 113 on a plug cap body 210 is provided with a notch or groove 143 between the first groove 141 and the second groove 142 so that the groove 143 communicates with the first and second grooves 141 and 142, thereby constituting an air flow passage 250 from the vent hole 123 to the plug bore 102.

Since tile other construction of the second embodiment P2 is the same as that of the first embodiment P1, the same elements or portions in both embodiments are indicated by the same reference numerals and corresponding explanations are omitted.

Figure 11:
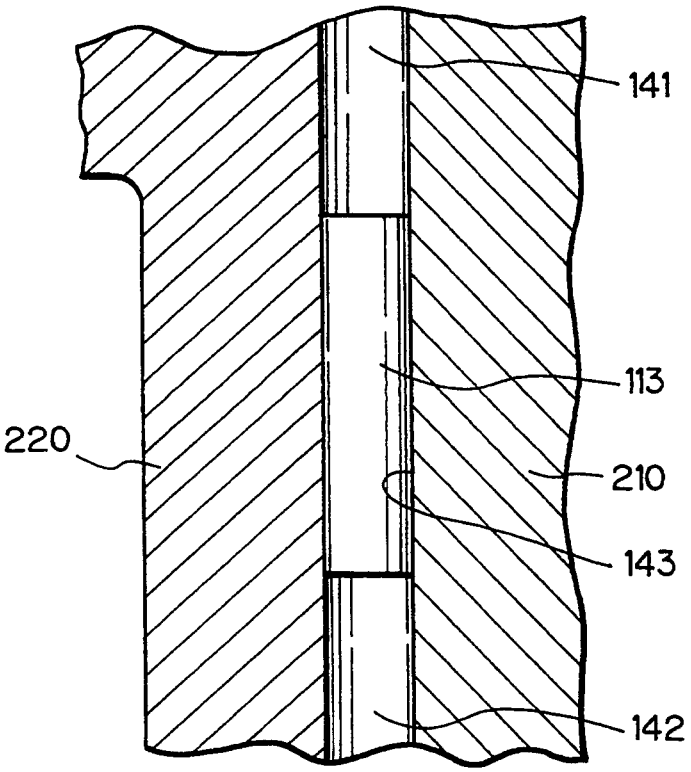
FIG. 11 is an enlarged view of a main part of FIG. 6.

In the plug cap device P2, since the groove 143 is formed in the rib 113 between the first and second grooves 141 and 142 so that the grooves 143 communicates with the first and second grooves 141 and 143 to form the air flow passage 250, as shown in FIG. 11, it is not necessary to form a groove for the air flow passage in the annular recess 122 and the wall around the annular recess 122 becomes relatively thick, thereby enhancing the rigidity of the rain cover 220.

Figure 12:
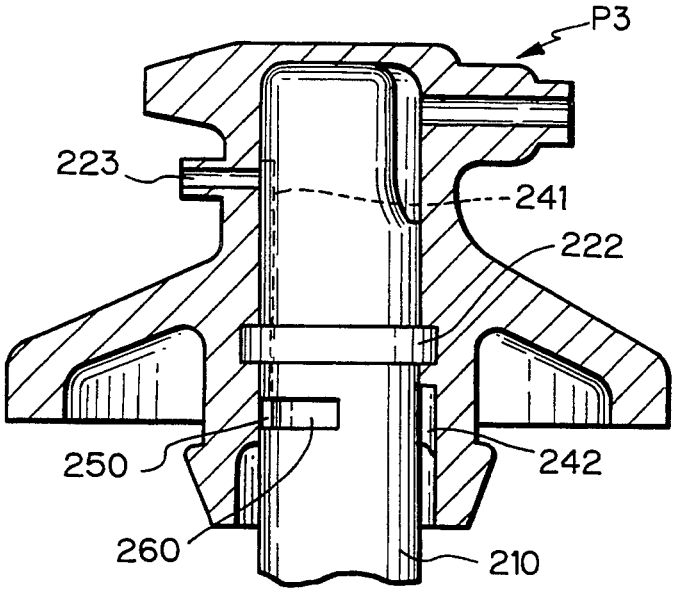
FIG. 12 is a side view of a third embodiment of a plug cap device of the present invention, in which a main part of the device is shown in a cross sectional view.
Figure 13:
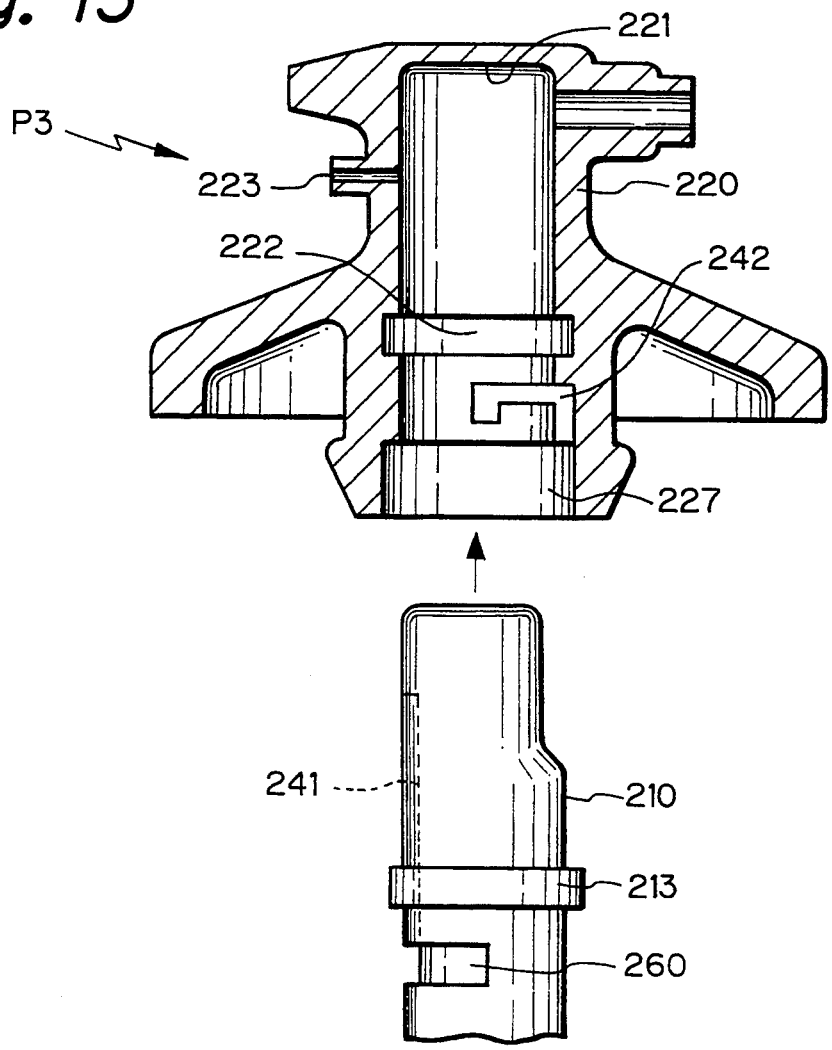
FIG. 13 is an exploded view of FIG. 12.
Figure 14:
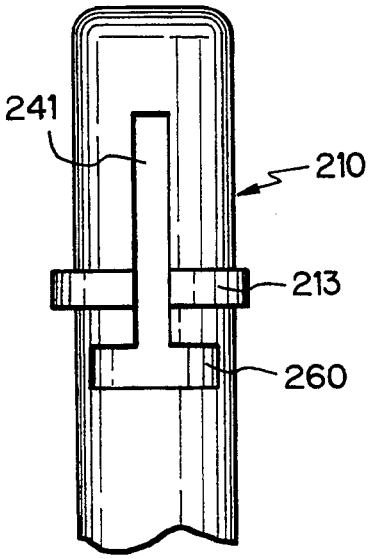
FIG. 14 is a front side view of a main part of a plug cap body to be applied to the third embodiment.
Figure 15:
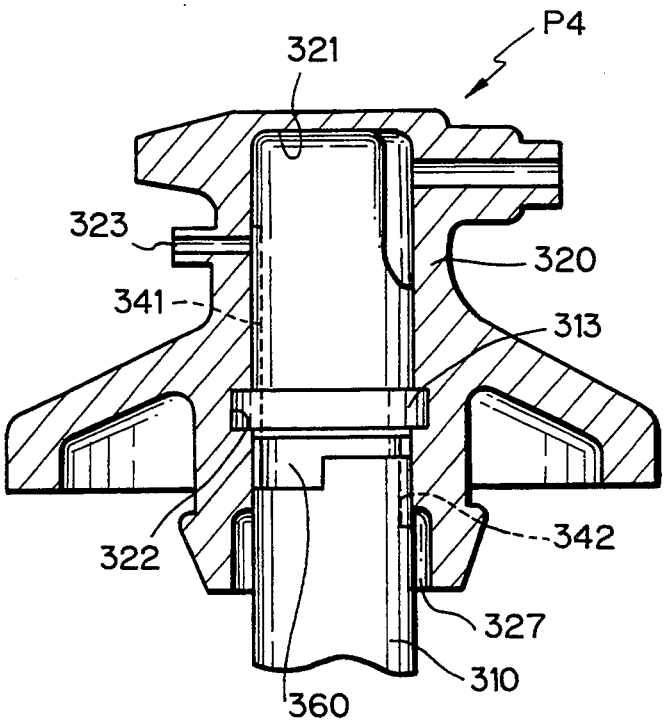
FIG. 15 is a side view of a fourth embodiment of a plug cap device of the present invention, in which a main part of the device is shown in a cross sectional view.
Figure 16:
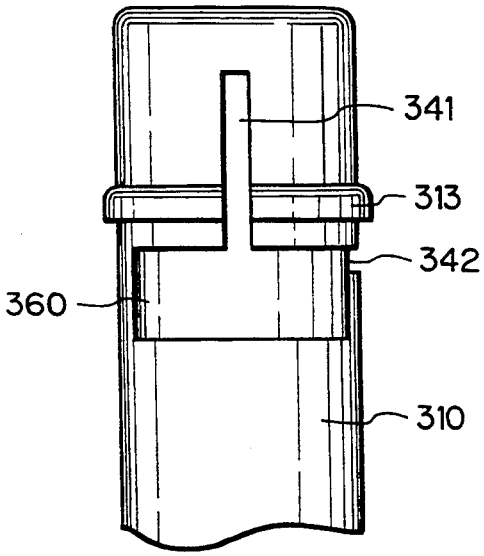
FIG. 16 is a front side view of a main part of a plug cap body to be applied to the fourth embodiment.
Figure 17:
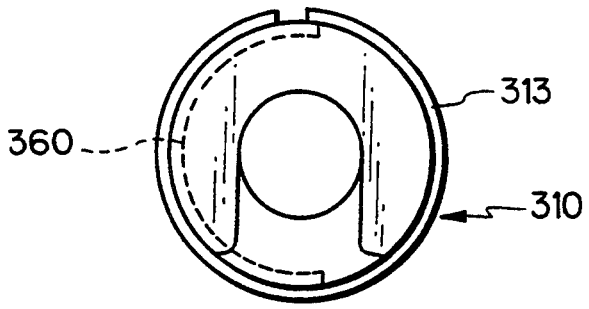
FIG. 17 is a top plan view of the plug cap body to be applied to the fourth embodiment.
Figure 18:
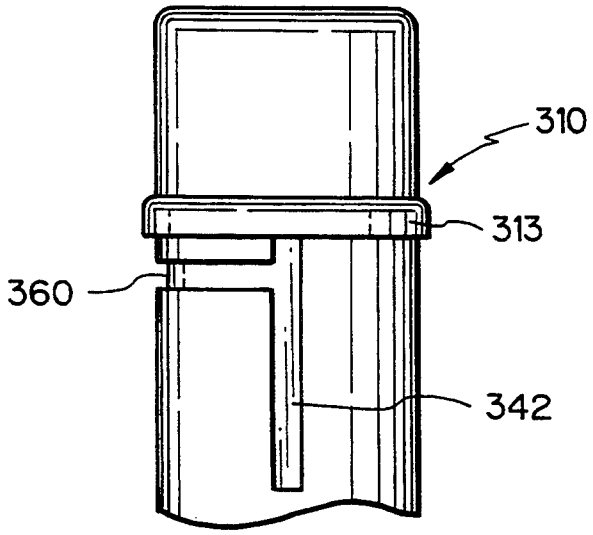
FIG. 18 is a rear side view of the plug cap body to be applied to the fourth embodiment.

FIGS. 12 through 14 show a third embodiment P3 of the plug cap device of the present invention. As shown in the drawings, the plug cap body 210 is provided with a water reservoir 260 on a half of the outer periphery at the position below an annular rib 213 to be described hereinafter and above a lower open end 227 of the rain cover 220. Further, the plug cap body 210 is provided on the outer periphery with a first groove 241 which extends downwardly along the axial direction from a position opposing to a vent hole 223 to the water reservoir 260. The plug cap body 210 Is provided on the outer periphery except the first groove 241 with the annular rib 213 above the water reservoir 260.

On the other hand, the rain cover 220 is provided with an annular recess 222 in opposition to the rib 213 on the inner periphery of the aperture 221 in the rain cover 220. Further, the rain cover 220 is provided with a second groove 242 on the inner periphery of the aperture 221. The second groove 242 extends along a fourth of the inner periphery of the aperture 221 in opposition to the water reservoir 260 below the annular recess 222 and turns downwardly and extends along the axial direction to the lower open end 227 of the rain cover 220.

The first groove 241 in the plug cap body 210 is opposite to the vent hole 223 in the rain cover 220 at the upper end thereof while a peripheral end of the water reservoir 260 is opposite to an end of the second groove 242. The plug cap body 210 is mated with the aperture 221 in the rain cover 220 at the upper end thereof so that the rib 213 engages with the recess 222. Consequently, the second groove 242 communicates with the water reservoir 260 so that the air flow passage 250 is defined by these portions 241, 260, and 242.

In the plug cap device P3, when an inner pressure in the plug bore is raised, air trapped in the plug bore is discharged through the air flow passage 250, which is constituted by the second groove 242, the water reservoir 260, and the first groove 241, from the vent hole 223 into the external area.

Water which enters from the vent hole 223 into the air flow passage 250 is received in the water reservoir 260 at the intermediate portion of the air flow passage 250, thereby preventing the water from entering into the plug bore. Further, the water received in the water reservoir 260 is vapoured by a rise in temperature in the plug bore and the vapour flow in a reverse manner in the air flow passage 250, so that the vapour is discharged from the vent hole 223 into the external area.

In the third embodiment P3 of the plug cap device, if the first and second grooves 241 and 242, and the water reservoir 260 which constitute the air flow passage 250 are formed in both the plug cap body 210 and the rain cover 220, a total volume in the grooves and recess becomes large, a cross sectional area of the air flow passage 250 becomes large, thereby ensuring a good ventilation in the air flow passage 250 and increasing a capacity of the water reservoir 260, in comparison with the prior device having a rain cover in which the air flow passage is formed.

FIGS. 15 through 18 show a fourth embodiment P4 of the plug cap device. As shown in the drawings, a plug cap body 310 is provided with a water reservoir 360 on the outer periphery below an annular rib 313 to be described hereinafter and above a lower open end 327 of a rain cover. The water reservoir extends along a half of the outer periphery of the body 310. Further, the plug cap body 310 is provided on the outer periphery with a first groove 341 extending along the axial direction from a position in opposition to a vent hole 323 to the water reservoir 360 and a second groove 342 extending alone a fourth of the periphery from an upper end of the water reservoir 30 and turning downwardly along the axial direction to the lower open end 327.

The plug cap body 310 is provided on the outer periphery except the first groove 341 with the annular rib 313 above the water reservoir 360.

An upper end of the plug cap body 310 is inserted into the aperture 321 in the rain cover 320 with the first groove 341 in the plug cap body 310 being opposite to the vent hole 323 in the rain cover 320 and with the rib 313 being fitted in the recess 322. Thus, the vent hole 323 communicates with the lower open end 327 of the rain cover 320 through the air flow passage 350 which includes the first groove 341, the water reservoir 360, and the second groove 342.

The other constructions in the fourth embodiment P4 are the same as those in the third embodiment P3.

In the plug cap device P4 similar to the above embodiments, when the inner pressure in the plug bore is raised, air trapped in the plug bore is discharged through the air flow passage 350 from the vent hole 323 into the external area.

Water which enters from the vent hole 323 into the air flow passage 350 is received in the water reservoir 360, thereby preventing the water from entering into the plug bore. The water received in the water reservoir is vapoured due to a rise in temperature in the plug bore and the vapour flows in a reverse manner in the air flow passage 350, so that the vapour is discharged from the vent hole into the external area.

In the fourth embodiment P4 of the plug cap device, since the first and second grooves 341 and 342 and the water reservoir 380 which constitute the air flow passage 350 are formed in the plug cap body 310, it is not necessary to form a groove for the air flow passage in the rain cover 320 and the thickness of a wall around the annular recess 322 becomes large, thereby enhancing the rain cover 320 in rigidity.

It should be noted that shapes of the air flow passages 150, 250, and 350 in the present invention are not limited to those shown in the above embodiments. In particular, if the air flow passage 350 in the fourth embodiment is formed in the plug cap body 310, the passage 350 may take various shapes because the rain cover 320 is not subject to a limitation of thickness.

Figure 19:
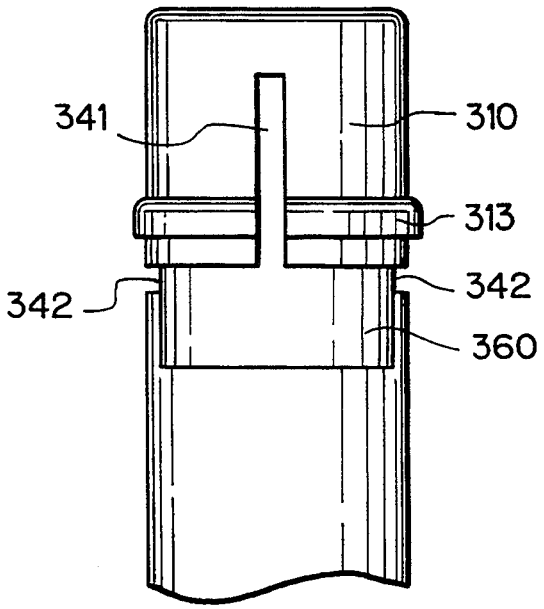
FIG. 19 is a front side view of a plug cap body to be applied to the fifth embodiment.
Figure 20:
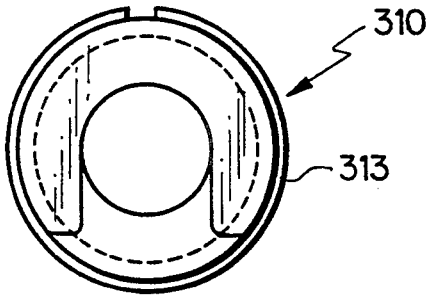
FIG. 20 is a top plan view of the plug cap body to be applied to the fifth embodiment.
Figure 21:
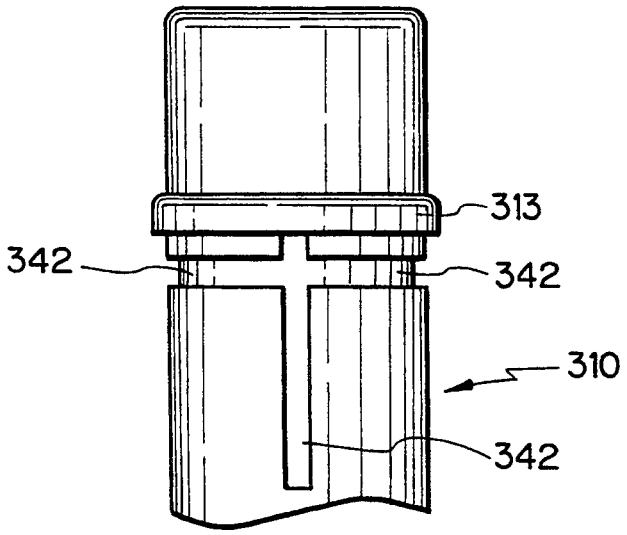
FIG. 21 is a rear side view of a main part of the plug cap body to be applied to the fifth embodiment.

For example, as shown in a fifth embodiment illustrated in FIGS. 19 through 21, the plug cap body 310 may be provided substantially on a half of the outer periphery below the rib 313 with the water reservoir 380. The first groove 341 is formed on the body 310 from a position opposite to the vent hole 323 to the water reservoir 360 while two second grooves 342 extend circumferentially from the opposite ends of the water reservoir 360, join together at the rear side, and turn downwardly at the joint point and extend to the lower open end of the rain cover, thereby defining the air flow passage 350.

Figure 22:
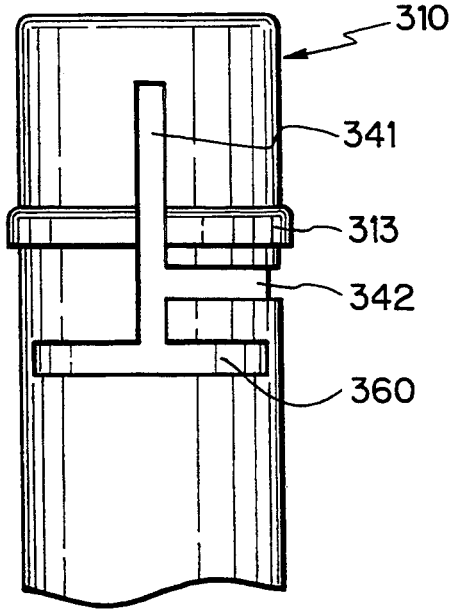
FIG. 22 is a front side view of a main part of a plug cap body to be applied to a sixth embodiment.
Figure 23:
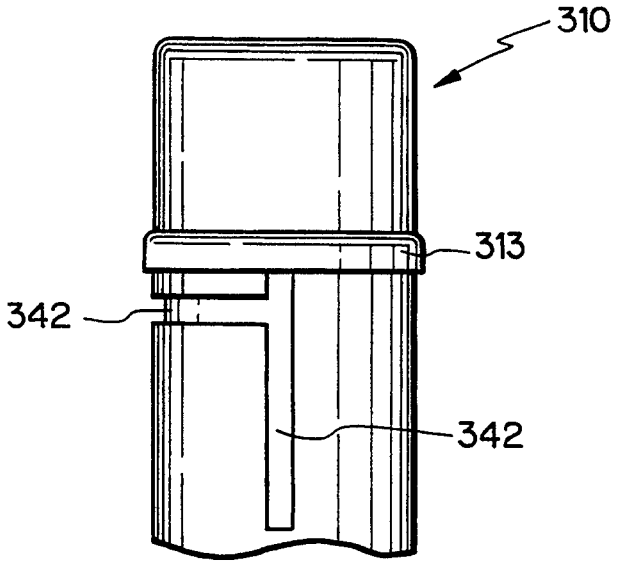
FIG. 23 is a rear side view of a main part of a plug cap body to be applied to the sixth embodiment.
Figure 24:
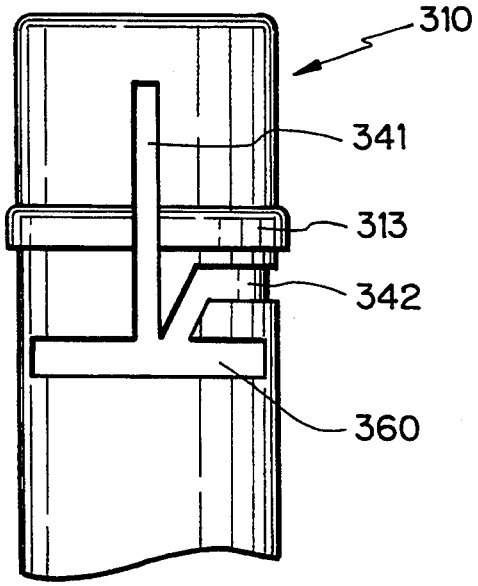
FIG. 24 is a front side view of a plug cap body to be applied to a seventh embodiment.
Figure 25:
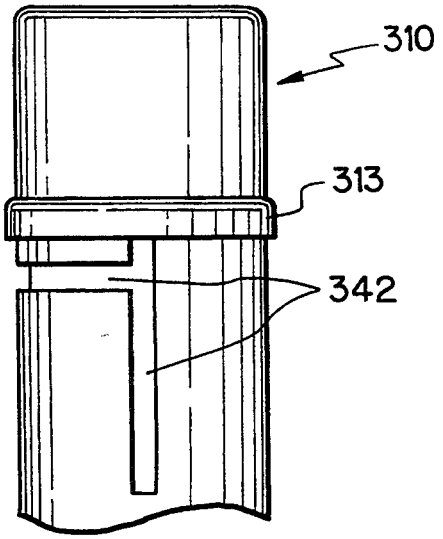
FIG. 25 is a rear side view of a main part of the plug cap body to be applied to the seventh embodiment.

As shown in a sixth embodiment of the present invention illustrated in FIGS. 22 and 23, the second groove 342 may be branched at an intermediate portion of the first groove 3.11 so that the air flow passage 350 is formed. As shown in a seventh embodiment of the present invention illustrated in FIGS. 24 and 25, the second groove 342 may be formed from a middle portion of the water reservoir 360 to a rear side on the outer periphery of the plug cap body 310 so that the air flow passage is defined.

Figure 26:
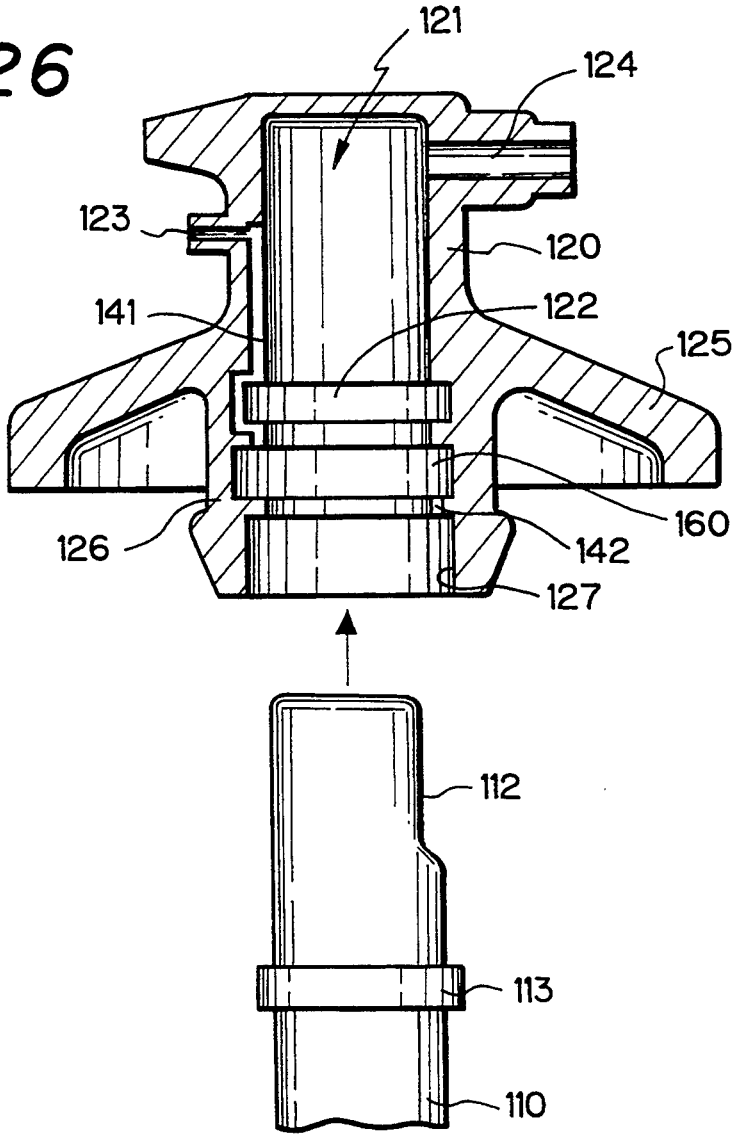
FIG. 26 is an exploded cross sectional view of a main part of an alternation of a plug cap device of the present invention.
Figure 27:
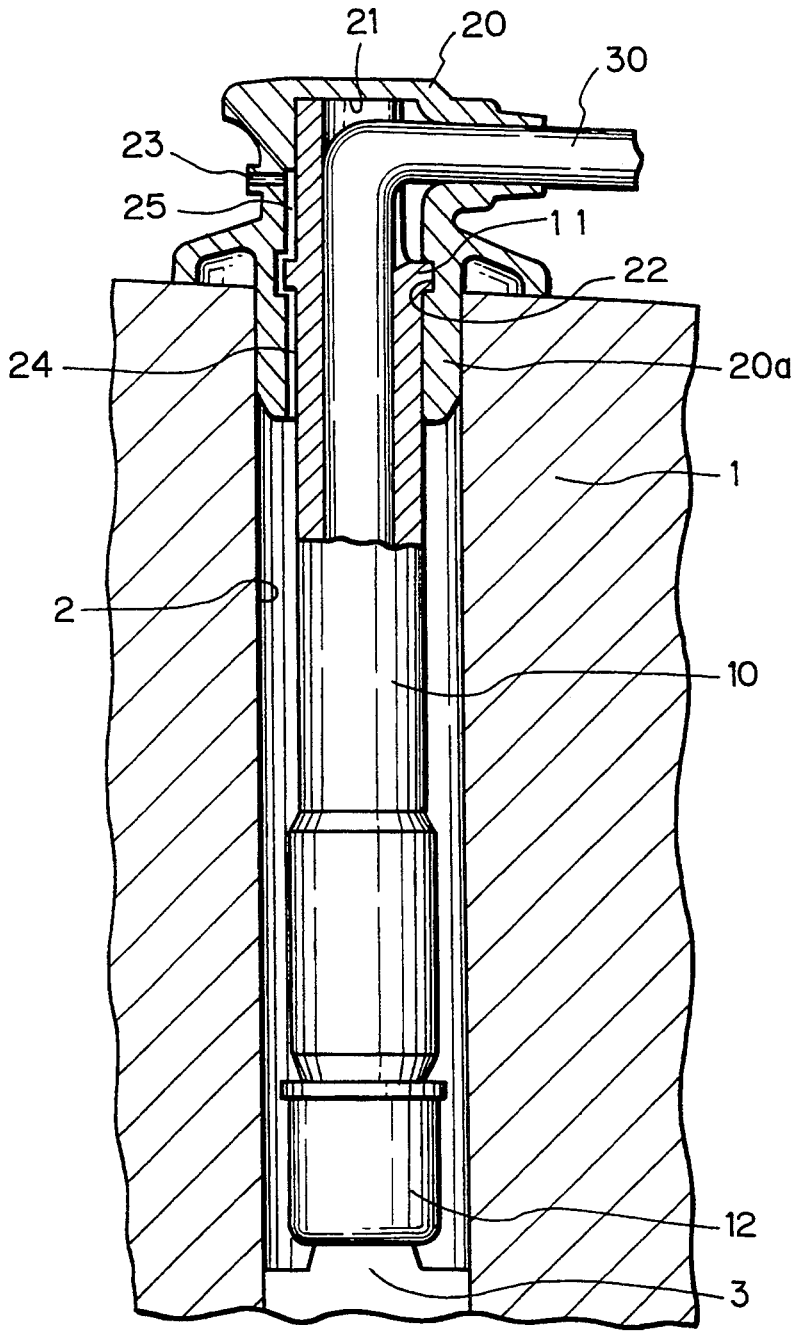
Fig. 27 PRIOR ART
FIG. 27 is a side view of a prior plug cap device, in which a main part of the device is shown in a cross sectional view.

Further, as shown in FIG. 26, unless the rain cover 120 is subject to a deterioration in rigidity, the water reservoir 160 may be formed on the inner periphery of the aperture 121 in the rain cover 120 below the recess 122 and above the lower open end 127 of the aperture 121.

In addition, the first groove 141 is formed on the inner periphery of the aperture 121 so that the first groove extends longitudinally from the vent hole 123 through the recess 122 to the water reservoir 160. The second groove 142 may be formed on an area opposite to the first groove 141 on the inner periphery of the aperture 121 so that the second groove 142 extends longitudinally from the water reservoir 160 to the lower open end 127 of the rain cover 120.

It will be apparent from the foregoing that according to the plug cap device of the present invention, since at least a part of the air flow passage is constructed by the groove formed in the plug cap body, it is not necessary to form a groove for an air flow passage in the water-proof cover at the area of the groove formed in the plug cap body, and consequently it is possible to make the water-proof cover relatively thick which can enhance in rigidity. Further, since the water reservoir is constructed by the recess formed in the outer periphery of the plug cap body at the intermediate portion of the air flow passage, a high pressure air trapped in the plug bore is discharged through the air flow passage from the vent hole into the external area. On the other hand, water which enters from the vent hole into the passage is received in the water reservoir and prevented from entering into the plug bore.

What is claimed is:

1. A plug cap device comprising:

a cylindrical plug cap body adapted to be detachably inserted into a plug bore extending vertically in an engine body;

a water-proof elastic cover adapted to be detachably and sealingly fitted in an upper end of said plug bore at a lower end thereof, said cover having an aperture for receiving an upper portion of said plug cap body and a vent hole in a wall defining said aperture;

an air flow passage being formed between said plug cap body and said water-proof elastic cover so that air in said plug bore is discharged through said vent hole to an external area; and a groove being formed on the outer periphery of said plug cap body so that said groove constitutes at least a part of said air flow passage.

2. A plug cap device according to claim 1, wherein said plug cap body is provided with a rib along the outer periphery thereof and said water-proof cover is provided along the inner periphery of said aperture with a recess which receives said rib; and wherein said plug cap body is provided on the outer periphery thereof with said groove which constitutes said air flow passage, said groove extending longitudinally from a position opposite to said vent hole across said rib to a position below a lower end of said water-proof body.

3. A plug cap device according to claim 1, wherein said plug cap body is provided with a rib along the outer periphery thereof and said water-proof cover is provided along the inner periphery of said aperture with a recess which receives said rib, wherein said rain cover is provided on the inner periphery of said aperture with a first groove extending from said vent hole to said recess and with a second groove extending from said recess to the lower end of said rain cover: and wherein said rib on said plug cap is provided with a third groove between said first and second grooves so that said third groove communicates with said first and second grooves, thereby constituting said air flow passage from said vent hole to the plug bore.

4. A plug cap device comprising:

a cylindrical plug cap body adapted to be detachably inserted into a plug bore extending vertically in an engine body;

a water-proof elastic cover adapted to be detachably and sealingly fitted in an upper end of said plug bore at a lower end thereof, said cover having an aperture for receiving an upper portion of said plug cap body and a vent hole in a wall defining said aperture;

an air flow passage being formed between said plug cap body and said water-proof elastic cover so that air in said plug bore is discharged through said vent hole to an external area;

a groove being formed on the outer periphery of said plug cap body so that said groove constitutes at least a part of said air flow passage; and a recess being formed on the outer periphery of said plug cap body so that said recess defines a water reservoir in an intermediate portion of said air flow passage.

5. A plug cap device according to claim 4, wherein said plug cap body is provided with a rib along the outer periphery thereof and said water-proof cover is provided along the inner periphery of said aperture with a recess which receives said rib, said plug cap body is provided with said water reservoir on a half of the outer periphery below said rib and above a lower open end of said rain cover; wherein said plug cap body is also provided on the outer periphery with a first groove which extends downwardly in the axial direction from a position opposite to said vent hole to said water reservoir; wherein said water-proof cover is provided with a second groove on the inner periphery of said aperture; and wherein said plug cap body is mated with said aperture in said rain cover at the upper end thereof so that said rib engages with said recess and a peripheral end of said water reservoir is opposite to an end of said second groove; whereby said second groove communicates with said water reservoir so that said air flow passage is defined by said grooves and reservoir.

6. A plug cap device according to claim 4, wherein said plug cap body is provided with a rib along the outer periphery thereof and said water-proof cover is provided along the inner periphery of said aperture with a recess which receives said rib, said plug cap body is provided with said water reservoir on the outer periphery below said rib and above said lower open end of said rain cover, wherein said water reservoir extends along a half of the outer periphery of said body; wherein said water reservoir extends along a half of the outer periphery of said body; and wherein said plug cap body is provided on the outer periphery with a first groove extending along the axial direction from a position opposite to said vent hole to said water reservoir and with a second groove extending along a fourth of the outer periphery from an upper end of said water reservoir and turning downwardly along the axial direction to said lower open end of said rain cover, so that said air flow passage is defined by said first and second groove and said water reservoir.

7. A plug cap device according to claim 4, wherein said plug cap body is provided with a rib along the outer periphery thereof and said water-proof cover is provided along the inner periphery of said aperture with a recess which receives said rib, said plug cap body is provided with said water reservoir on a half of the outer periphery below said rib; wherein a first groove is formed on said body from a position opposite to said vent hole to said water reservoir; and wherein two second grooves extend circumferentially from the opposite ends of said water reservoir, joint together at the rear side of said plug cap body, and turn downwardly at the joint point and extend to the lower open end of said rain cover, so that said air flow passage is defined by said first and second grooves.

8. A plug cap device according to claim 7, wherein said second groove is branched at an intermediate portion of said first groove so that said air flow passage is formed.

9. A plug cap device according to claim 7, wherein said second groove is formed from a middle portion of said water reservoir to the rear side on the outer periphery of said plug cap body so that said air flow passage is defined.

* * * * *